US005883507A

United States Patent [19]

Yin

[11] Patent Number: 5,883,507

[45] Date of Patent: Mar. 16, 1999

[54] LOW POWER TEMPERATURE COMPENSATED, CURRENT SOURCE AND ASSOCIATED METHOD

[75] Inventor: Rong Yin, Coppell, Tex.

[73] Assignee: STMicroelectronics, Inc., Carrollton, Tex.

[21] Appl. No.: 853,764

[22] Filed: May 9, 1997

[51] Int. Cl.[6] ..... G05F 3/16

[52] U.S. Cl. ..... 323/316; 323/907; 327/512

[58] Field of Search ..... 323/312, 315, 323/316, 407; 327/512, 538, 539

[56] References Cited

U.S. PATENT DOCUMENTS

| | | | |
|---|---|---|---|
| 4,967,139 | 10/1990 | Betti et al. | 323/312 |
| 5,087,891 | 2/1992 | Cytera | 330/288 |
| 5,103,159 | 4/1992 | Breugnot et al. | 323/315 |
| 5,221,888 | 6/1993 | Moody | 323/315 |
| 5,298,870 | 3/1994 | Cytera et al. | 331/45 |
| 5,373,226 | 12/1994 | Kimura | 323/313 |
| 5,373,258 | 12/1994 | Gerot et al. | 331/14 |
| 5,479,092 | 12/1995 | Pigott et al. | 323/315 |
| 5,686,825 | 11/1997 | Suh et al. | 323/316 |
| 5,777,509 | 7/1998 | Gasparik | 323/312 |

*Primary Examiner*—Peter S. Wong
*Assistant Examiner*—Derek J. Jardieu
*Attorney, Agent, or Firm*—Theodore E. Galanthay; Lisa K. Jorgenson; Christopher F. Regan

[57] ABSTRACT

An integrated circuit and method are provided for generating current for low power applications. The integrated circuit preferably includes a current generating circuit responsive to a supply voltage for generating a first reference current and a temperature compensating voltage controlling circuit for generating a temperature compensated voltage control signal during temperature variations. A bias controlling circuit is preferably connected to the current generating circuit and the temperature compensating voltage control circuit for biasingly controlling the temperature compensating voltage control circuit. A current output controlling circuit is connected to the current generating circuit and the temperature compensating voltage controlling circuit for controlling a second temperature compensated reference current responsive to the temperature compensated voltage control signal so as to generate a high output source current even during low temperature conditions.

40 Claims, 4 Drawing Sheets

LOW POWER TEMPERATURE COMPENSATED, CURRENT SOURCE AND ASSOCIATED METHOD

FIELD OF THE INVENTION

The present invention relates to the field of integrated circuits, and, more particularly, to an integrated circuit and method having a constant current source.

BACKGROUND OF THE INVENTION

Integrated circuits are widely used in many electronic applications. Current sources for these integrated circuits are often made by using active devices both as biasing elements and as load devices for amplifier stages. The use of current sources in biasing, for example, can result in improved sensitivity of circuit performance to power-supply variations and to temperature. Current sources also are often more economical than resistors in terms of the die area needed to provide bias current of selected values. When current sources are used as load devices in transistor amplifiers, the high incremental resistance of the current source can result in high voltage gain at low power-supply voltages.

Current sources, for example, can be formed from or include a field-effect transistor and a reference voltage source that biases the gate of the transistor. The reference source voltage can be a so-called "bandgap" type which generally refers to the energy interval between the valence bands and the conduction bands of a semiconductor. Current sources of this type conventionally use a known relationship of dependency between this interval and the temperature to achieve compensations that make the reference voltage as stable as possible as a function of the temperature.

A bandgap-type voltage source generally has two diodes through which flow different currents and a looped differential amplifier amplifying the voltage difference at the terminals and supplying the diodes with current. The current through the diodes can also be the same current, but if the current is the same, then the diodes are necessary and will generally have different junction surfaces. A current source can be made from this type of voltage source, but the stability in temperature is often lost during the voltage-to-current conversion.

Another type of current source is the "Wilson mirror" sources. A source of this kind is generally based upon mutually compensating variations in the characteristics of several transistors which mutually copy one another's currents. A Wilson mirror source conventionally has two parallel branches with two transistors each, and the transistors are mounted so that each branch copies the current of the other one. Two transistors which each belong to a different branch are different in size or in threshold voltage.

Modifications to this Wilson mirror type have been developed which further attempt to stabilize the current source for temperature variations. These modifications, for example, can include adding additional transistors such as in an MOSFET cascade current source illustrated in FIG. 1 or combining the Wilson mirror type and the bandgap type sources such as seen in U.S. Pat. No. 5,103,159 by Breugnot et al. titled "Current Source With Low Temperature Coefficient." Although some stability can be obtained with these modified current sources, either the stability or the performance can be considered lacking for many low power applications such as low power clocks, low current oscillators, or controlling gain stages, dividers, level shifters, or other functions of various low power integrated circuit designs.

SUMMARY OF THE INVENTION

With the foregoing in mind, the present invention advantageously provides a low power, temperature compensated, current source and methods. The present invention also advantageously provides a current source for low power applications which generates a high current even at low temperatures. Additionally, the present invention advantageously provides an integrated circuit having a portion of the circuit which lowers the voltage as the temperature increases above a predetermined threshold and inhibits voltage as the temperature decreases below the predetermined threshold. In low power applications, for example, an integrated circuit of the present invention advantageously allows a relatively high current flow even during low temperature conditions where the performance of the application, e.g., a crystal oscillator, would otherwise be expected to deteriorate due to little or no current being supplied to the application.

More particularly, an integrated circuit according to the present invention preferably includes current generating means responsive to a supply voltage for generating an output source current. The integrated circuit also includes temperature compensating voltage control signal generating means responsive to the supply voltage for generating a temperature compensated voltage control signal during temperature variations. The temperature compensating voltage controlling means is preferably provided by a temperature compensating voltage controlling circuit connected to the supply voltage and arranged so that the voltage control signal, e.g., from the supply voltage to a gate of an output transistor, decreases as temperature increases above a predetermined threshold. The temperature compensating voltage controlling circuit also inhibits the voltage control signal as temperature decreases below the predetermined threshold so as to generate a high output source current even during low temperature conditions.

According to another aspect of the present invention, an integrated circuit preferably has current generating means responsive to a supply voltage for generating a first reference current and temperature compensating voltage control signal generating means connected to the supply voltage for generating a temperature compensated voltage control signal during temperature variations. The integrated circuit also preferably has bias controlling means responsive to the current generating means and connected to the temperature compensating voltage controlling means for biasingly controlling the temperature compensating voltage controlling means. Current output controlling means is responsive to the current generating means and the temperature compensated voltage control signal for controlling a second temperature compensated reference current so as to generate a high output source current even during low temperature conditions.

Advantageously, the current output control means preferably includes at least one output transistor which provides a temperature compensated reference current output when the temperature is above the predetermined threshold. When the temperature falls below the predetermined threshold, however, the at least one output transistor will be turned off and the second reference current will mirror the first reference current during these low temperature conditions.

The present invention also includes methods of supplying current for low power applications. A method according to the present invention preferably includes generating a reference current responsive to a supply voltage and generating a temperature compensated voltage control signal during temperature variations by decreasing the voltage control signal when temperature increases above a predetermined threshold and inhibiting the voltage control signal when temperature decreases below the predetermined threshold so as to generate a high output source current even during low temperature conditions.

Another method according to the present invention preferably includes generating a first reference current responsive to a supply voltage and generating a temperature compensated voltage control signal during temperature variations. A second temperature compensated reference current is controlled responsive to the temperature compensated voltage control signal so as to generate a high output source current even during low temperature conditions.

Further, because an integrated circuit and methods of the present invention advantageously provide two reference currents instead of only one reference current, the first or original current reference can be used to control a first portion of circuitry, such as an oscillator, and the temperature compensated current reference can be used to control other portions of the circuitry, such as dividers and level shifters. In essence, with the same battery or supply current at room temperature, the operation temperature range of at least portions of low power applications can advantageously be extended by using the integrated circuit and methods of the present invention.

BRIEF DESCRIPTION OF THE DRAWINGS

Some of the features, advantages, and benefits of the present invention having been stated, others will become apparent as the description proceeds when taken in conjunction with the accompanying drawings in which.

DETAILED DESCRIPTION OF A PREFERRED EMBODIMENT

The present invention will now be described more fully hereinafter with reference to the accompanying drawings which illustrate a preferred embodiment of the invention. This invention may, however, be embodied in many different forms and should not be construed as limited to the illustrated embodiments set forth herein. Rather, these illustrated embodiments are provided so that this disclosure will be thorough and complete, and will fully convey the scope of the invention to those skilled in the art.

Figure 1:
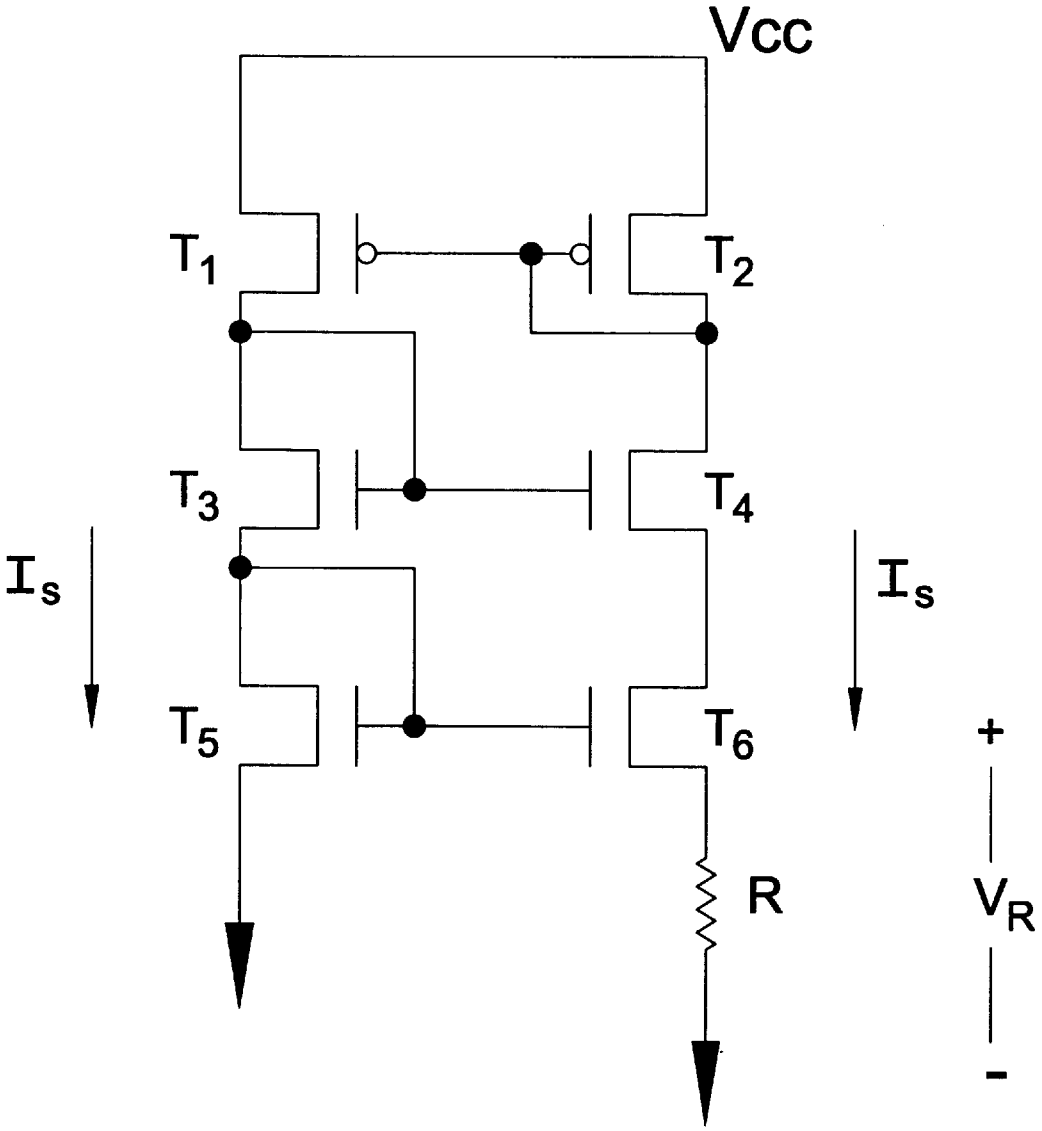
FIG. 1 (PRIOR ART)
FIG. 1 is a schematic block diagram of a prior art current source.

FIG. 1 illustrates a prior art current source formed by three pairs of field effect transistors $T_1$, $T_2$, $T_3$, $T_4$, $T_5$, $T_6$ connected to a supply voltage $V_{CC}$. The transistors $T_1$, $T_2$, $T_3$, $T_4$, $T_5$, $T_6$ have a cascading mirror configuration with each pair having commonly connected gates. A resistor R is connected to the source of one of the transistors $T_6$ which also indicates a voltage $V_R$ across the resistor R. The reference current $I_S$ will relate to the size (W/L) of the transistors $T_1$, $T_2$, $T_3$, $T_4$, $T_5$, $T_6$ and, more particularly, four of the transistors $T_1$, $T_2$, $T_5$, $T_6$. As recognized and understood by those skilled in the art, for a given resistor type, the reference current $I_S$ will generally increase with increasing temperature. For low power applications, however, this current $I_S$ can be critical to the design and performance of the application. For example, when used with the design and operation of a low power crystal oscillator, during low temperature conditions the performance of dividers and a level shifter of the associated circuit can deteriorate due to little or no current being supplied to the oscillator.

Figure 2:
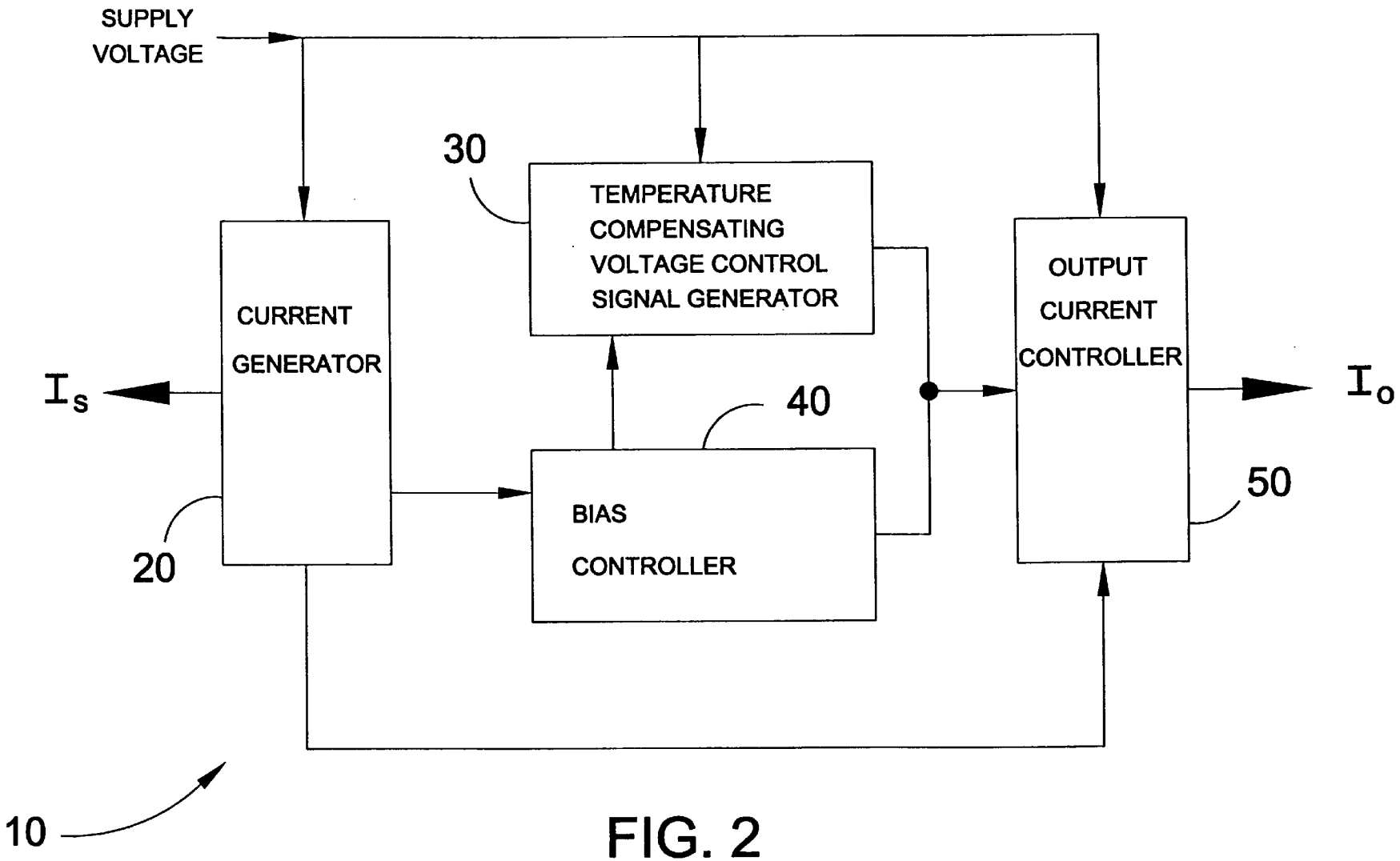
FIG. 2 is a schematic block diagram of an integrated circuit having a low power, temperature compensated, current source according to an embodiment of the present invention.
Figure 3:
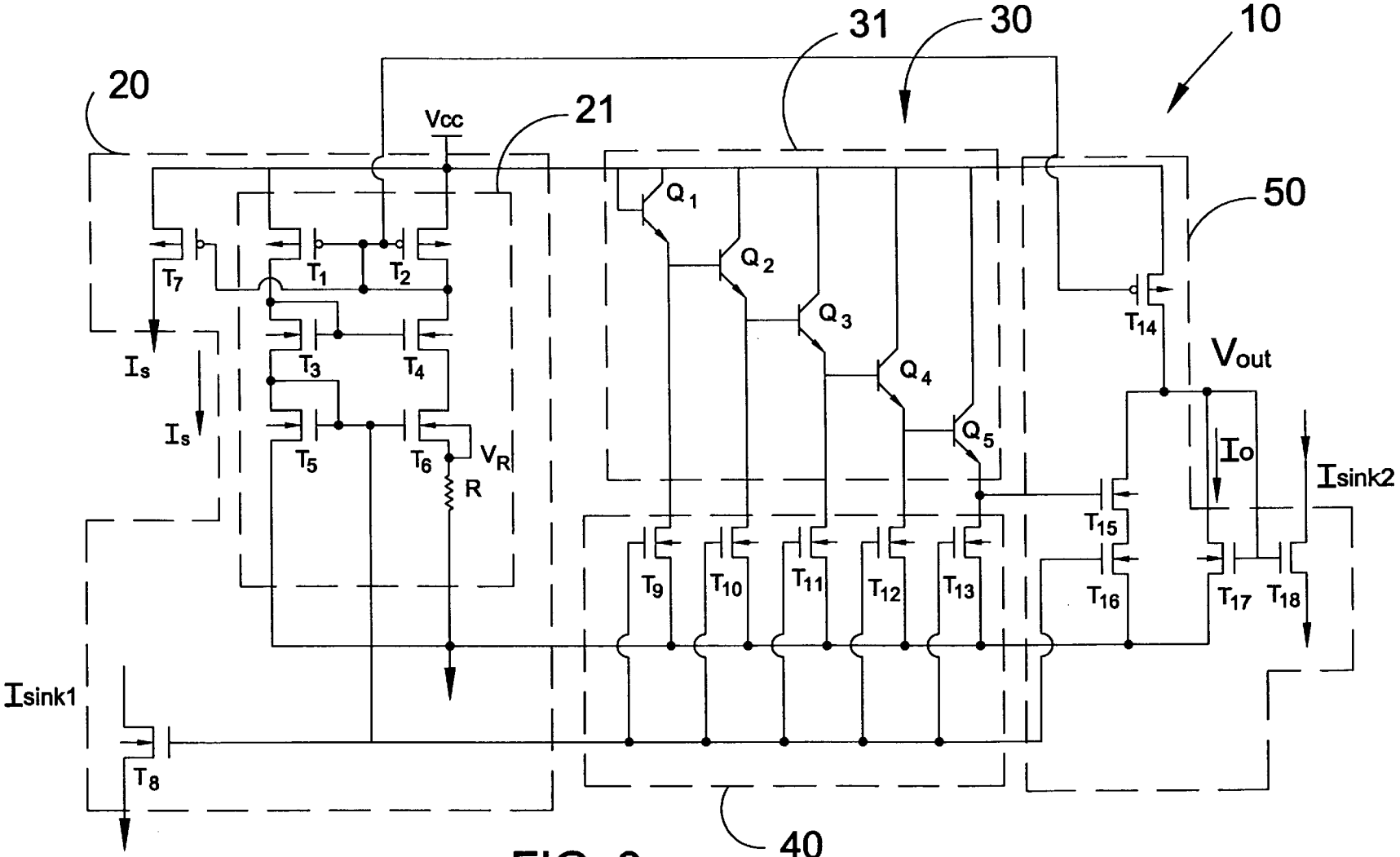
FIG. 3 is a schematic circuit diagram of an integrated circuit having a low power, temperature compensated, current source according to an embodiment of the present invention.

FIGS. 2–3, on the other hand, illustrate an integrated circuit 10 having a low power, temperature compensated, current source according to the present invention which advantageously provides a current source for low power applications which generates a high current even at low temperatures. As perhaps best illustrated in FIG. 2, the integrated circuit 10 preferably has current generating means 20 responsive to a supply voltage, e.g., $V_{cc}$ for generating a first reference current $I_S$ and temperature compensating voltage control signal generating means 30 responsive to the supply voltage $V_{cc}$ for generating a temperature compensated voltage control signal during temperature variations. Bias controlling means 40 is responsive to the current generating means 20 and connected to the temperature compensating voltage controlling means 30 for biasingly controlling the temperature compensating voltage controlling means 30. Current output controlling means 50 is responsive to the current generating means 20 and the temperature compensated voltage control signal for controlling a second temperature compensated reference current $I_O$ so as to generate a high output source current $I_O$ even during low temperature conditions.

As illustrated in more detail in FIG. 3, the current generating means 20 is preferably provided by a first current source 21 which includes a cascading current mirror circuit connected to a supply voltage $V_{CC}$. The cascading current mirror circuit has three pairs of field effect transistors $T_1$, $T_2$, $T_3$, $T_4$, $T_5$, $T_6$. One of the pairs of field effect transistors $T_1$, $T_2$ has a first conductivity type, e.g., PMOS, and two of the pairs of field effect transistors $T_3$, $T_4$, $T_5$, $T_6$ have a second conductivity type, e.g., NMOS. The current generating means 20 further includes a field effect transistor $T_7$ connected to the gates of the first pair of field effect transistors $T_1$, $T_2$. This transistor $T_7$ preferably has the same conductivity type, i.e., PMOS, as the first pair for providing the first reference current or reference current $I_S$. A field effect transistor $T_8$ is also connected to the gates of a third pair of the field effect transistors $T_5$, $T_6$ and has the same conductivity type, i.e., NMOS, of this third pair of transistors for providing a first sinking current $I_{SINK1}$. The current generating means 20 also has a resistor R, e.g., about 2 MΩ, connected to the source of the transistor $T_6$ which also indicates a voltage $V_R$ across the resistor R.

As also illustrated in FIG. 3, the temperature compensating voltage control signal generating means 30 is preferably provided by a temperature compensating voltage controlling circuit 31 connected to the supply voltage $V_{CC}$. The temperature compensating voltage controlling circuit 31 is preferably arranged so that the voltage control signal, which biases at least one output transistor $T_{15}$, i.e., from the supply voltage $V_{CC}$ to the gate of $T_{15}$, as described in further detail herein below, decreases as temperature increases above a predetermined threshold. The temperature compensating voltage controlling circuit 31 also inhibits the voltage control signal from being initiated or turns off the output transistor $T_{15}$ as temperature decreases below the predetermined threshold.

The temperature compensating voltage controlling circuit 31 in the illustrated embodiment includes a plurality of bipolar transistors $Q_1$, $Q_2$, $Q_3$, $Q_4$, $Q_5$. Each of the plurality of bipolar transistors $Q_1$, $Q_2$, $Q_3$, $Q_4$, $Q_5$ are preferably formed in a common well, e.g., a P-well as illustrated or an N-well as understood by those skilled in the art. Each of the bipolar transistors $Q_1$, $Q_2$, $Q_3$, $Q_4$, $Q_5$ has a collector connected to the supply voltage $V_{CC}$ and has an emitter connected to the bias controlling means 40.

More specifically, the temperature compensating voltage controlling circuit 31 as illustrated has five bipolar transistors $Q_1$, $Q_2$, $Q_3$, $Q_4$, $Q_5$. These bipolar transistors $Q_1$, $Q_2$, $Q_3$, $Q_4$, $Q_5$ preferably are n-p-n vertical bipolar transistors so that the integrated circuit can still be a straight CMOS design. Bipolar transistors may be preferable for the circuit because the base-to-emitter voltages are more stable. A first transistor $Q_1$ of the five bipolar transistors $Q_1$, $Q_2$, $Q_3$, $Q_4$, $Q_5$ also has a base connected to the supply voltage $V_{CC}$. Each of the bases of the other four bipolar transistors are connected to the emitter of the preceding bipolar transistor.

This temperature compensating voltage controlling circuit 31 advantageously has a negative temperature coefficient, e.g., about −2 mV/°C. This, for example, advantageously allows the output biasing voltage to decrease as temperature increases above a predetermined threshold. This predetermined threshold, for example, can range from −20° C. to +20° C. depending on the process and can generally depend on the threshold voltage $V_T$ of the circuit or the selected transistors of the circuit. The temperature compensating voltage controlling circuit 31 also advantageously inhibits the output biasing voltage by turning off or not biasing the first output transistor $T_{15}$ of the current output controlling means 50 as temperature decreases below the predetermined threshold.

The bias controlling means 40 is preferably provided by a bias control circuit which has a plurality of field effect transistors, preferably provided by the five transistors $T_9$, $T_{10}$, $T_{11}$, $T_{12}$, $T_{13}$ as illustrated in FIG. 3. Each of the plurality of field effect transistors $T_9$, $T_{10}$, $T_{11}$, $T_{12}$, $T_{13}$ has a drain connected to the temperature compensating voltage controlling means 30,and a gate connected to at least one of the gates of at least one, i.e., $T_5$, $T_6$ of the pairs of field effect transistors $T_1$, $T_2$, $T_3$, $T_4$, $T_5$, $T_6$ of the cascading current mirror circuit. More particularly, the drain of each of the five field effect transistors $T_9$, $T_{10}$, $T_{11}$, $T_{12}$, $T_{13}$ of the bias controlling circuit is preferably connected to a respective emitter of the five bipolar transistors $Q_1$, $Q_2$, $Q_3$, $Q_4$, $Q_5$ of the temperature compensating voltage control circuit for biasing the respective bipolar transistors as illustrated.

The current output controlling means 50 is preferably provided by a current output control circuit which controls the temperature compensated reference current $I_O$. The current output control circuit includes a first output field effect transistor $T_{15}$ which has the gate thereof connected to the temperature compensating voltage controlling means 30, e.g., to the emitter of the bipolar transistor $Q_5$, and the bias controlling means 40, e.g., to the drain of the field effect transistor $T_{13}$. The first output transistor $T_{15}$ is responsive to the output biasing voltage received from the temperature compensating voltage controlling means 30 as illustrated. This first output transistor $T_{15}$ also has the second conductivity type, e.g., NMOS. A second output field effect transistor $T_{14}$ has the gate thereof connected to the gate of one of the first pair $T_1$, $T_2$ of the three pairs of transistors of the cascading current mirror circuit so as to form a current mirror therewith.

The second output transistor $T_{14}$ has the first conductivity type, e.g., PMOS, and the source of this second output field effect transistor $T_{14}$ is connected to the drain of the first output field effect transistor $T_{15}$. The gate of the second output transistor $T_{14}$ is connected to the gate of one of the field effect transistors $T_1$ of the cascading current mirror circuit so that the second output transistor $T_{14}$ forms a current mirror with this transistor $T_1$.

A third output field effect transistor $T_{16}$of the output controlling circuit has the gate thereof connected to the gate of one of the third pair $T_5$ of the three pairs of transistors $T_1$, $T_2$, $T_3$, $T_4$, $T_{5,\ T6}$ of the cascading current mirror circuit so as to advantageously form a current mirror therewith. The third output transistor $T_{16}$ also has the second conductivity type, e.g., NMOS, or the same conductivity type as the first output transistor $T_{15}$. The drain of the third output field effect transistor $T_{16}$ is connected to the source of the first output field effect transistor $T_{15}$.

The current output control circuit further includes fourth and fifth output field effect transistors $T_{17}$, $T_{18}$. The fourth and fifth output transistor $T_{17}$, $T_{18}$ preferably have the same conductivity type, e.g., NMOS, and have the gates thereof respectively connected to each other, e.g., in a current mirror configuration. The fifth output field effect transistor $T_{18}$ preferably provides a second sinking current $I_{SINK2}$ along the drain thereof as illustrated.

The drain of the fourth output field effect transistor $T_{17}$ is preferably connected to the respective drain and source of the first and second output field effect transistors $T_{15}$, $T_{14}$ so that the second temperature compensated reference current $I_O$ flows toward the drain of the fourth output field effect transistor $T_{17}$ as illustrated by the arrow. In the design of this integrated circuit 10 of the present invention, more current was advantageously sacrificed at the current source stage instead of increasing overall current to obtain the same low temperature performance. The new current reference or temperature compensated current reference $I_O$ generally has a maximum value at the first reference current $I_S$ and a minimum value of less than the first reference current $I_S$, e.g., 85% of $I_S$. The minimum value, for example, can be selectively determined based upon the transistor size. Under high temperature conditions, as well as low voltage threshold $V_T$ corner or high battery voltage as understood by those skilled in the art, the voltage from the temperature compensating voltage control circuit and the first current source is high enough to make both the first output transistor $T_{15}$ and the third output transistor $T_{16}$ turn on.

Advantageously, in essence, the current output control means 50 preferably includes at least one output transistor $T_{15}$ which provides a temperature compensated reference current output $I_O$, when the temperature is above the predetermined threshold. When the temperature falls below the predetermined threshold, however, the at least one output transistor $T_{15}$ will be turned off and the second reference current $I_O$ will mirror the first reference current $I_S$ during these low temperature conditions. In other words, the temperature compensating voltage control signal generating means 30 preferably has a first operating state where the voltage control signal decreases as temperature increases above a predetermined threshold and a second operating state where the voltage controlling means 30 is disabled as temperature decreases below the predetermined threshold so that the second reference current mirrors the first reference current as the high output current during low temperature conditions.

For example, during low temperature operation, as well as high voltage threshold $V_T$ corner or low battery voltage as understood by those skilled in the art, the first output transistor $T_{15}$ is turned off, and the current at the fourth output transistor $T_{17}$, i.e., $I_O$, is advantageously the same as the current at the second output transistor $T_{14}$ which mirrors with the current at the transistor $T_1$ of the first current source which is significantly more temperature dependent. This, in essence, provides the same reference current or high output current $I_O$ even at low temperatures. If, on the other hand, the first output transistor $T_{15}$ is turned on, the output reference current $I_O$ will be approximately the current $I_{T14}$ at the second output transistor $T_{14}$ minus the current $I_{T16}$ at the third output transistor $T_{16}$ so that the output reference current $I_O$ is more effectively temperature compensated.

Figure 4:
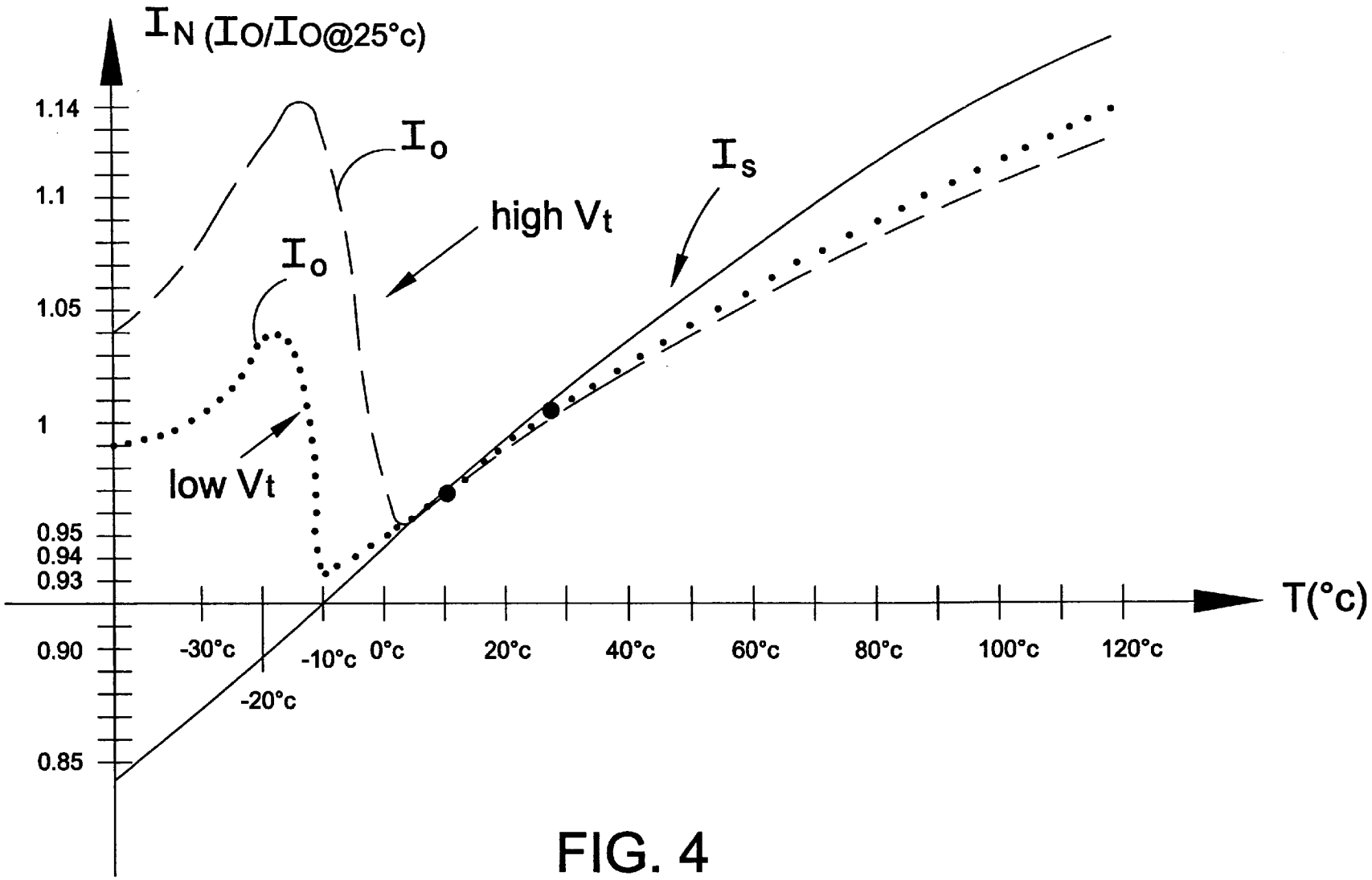
FIG. 4 is a graphical diagram of normalized current versus temperature for a low power, temperature compensated, current source according to an embodiment of the present invention.

FIG. 4 illustrates simulated performance results of an integrated circuit 10 having a temperature compensated reference current $I_O$ and using a SPICE simulation software program as understood by those skilled in the art. The graphical diagram shows a normalized current reference $I_N$, i.e. , $I_{O(at\ temperature\ T)}/I_{O(at\ 25\ degrees\ Centigrade)}$, versus temperature T. The reference current without temperature compensation $I_S$ is illustrated in solid lines, the temperature compensated reference current $I_O$ at a low voltage threshold is illustrated in dotted lines, and the temperature compensated reference current $I_O$ at high voltage threshold is illustrated in dashed lines.

As illustrated in FIGS. 2–4, the present invention also includes methods of supplying current for low power applications. A method of supplying current for low power applications according to the present invention preferably includes generating a reference current $I_S$ responsive to a supply voltage $V_{CC}$ and generating a temperature compensated voltage control signal during temperature variations by decreasing the voltage control signal when temperature increases above a predetermined threshold and inhibiting the voltage control signal, e.g., so as to turn off at least one output transistor $T_{15}$, when temperature decreases below the predetermined threshold so as to generate a high output source current $I_O$, e.g., which is a mirror of the reference current $I_S$ during low temperature conditions (see, e.g., FIG. 4). The method can also include the generating of the reference current $I_S$ by mirroring current through a cascading current mirror circuit connected to the supply voltage $V_{CC}$.

Another method according to the present invention preferably includes generating a first reference current responsive to a supply voltage $V_{CC}$ and generating a temperature compensated voltage control signal during temperature variations. A second temperature compensated reference current is controlled responsive to the temperature compensated voltage control signal so as to generate a high output source current even during low temperature conditions.

The method can also include the temperature compensated voltage control signal being generated by decreasing the voltage control signal when temperature increases above a predetermined threshold and inhibiting the voltage control signal when temperature decreases below the predetermined threshold. The generating of the output source current can include mirroring current through a cascading current mirror circuit connected to the supply voltage $V_{CC}$.

The method can further include biasingly controlling the temperature compensating voltage controlling circuit during temperature variations so as to maintain the high output source current during low temperature conditions. Advantageously, the first reference current can be provided from a first output current source so as to control a first portion of another circuit, and the second temperature compensated reference current can be provided from a second output current source so as to control a second portion of another circuit.

In low power applications, for example, an integrated circuit 10 and methods of the present invention advantageously allows a relatively high current flow even during low temperature conditions where the performance of the application, e.g., a crystal oscillator, would otherwise be expected to deteriorate due to little or no current being supplied to the application. In accomplishing the functions and performance of the present invention, the integrated circuit 10 is advantageously designed for straight CMOS integrated circuit design which will thereby provide all of the advantages of CMOS, e.g., low power, as understood by those skilled in the art. As also understood by those skilled in the art, although the integrated circuit 10 and methods illustrated can advantageously be used and has been described with reference to low power clock or low power crystal oscillator circuit design, the present invention can advantageously be used in various other applications where low power is an important design criteria and where the temperature variations can impact the performance of the desired application.

Another advantage of an integrated circuit 10 and methods of the present invention is that the integrated circuit 10 and methods provide two reference currents $I_S$, $I_O$ instead of only one reference current $I_S$. This can advantageously be used, for example, where the series resistance within a crystal oscillator is normally proportional to temperature. The higher the series resistance of the oscillator, the more current is needed for performance. Therefore, the first or original current reference $I_S$, can be used to control the oscillator gain stage, and the temperature compensated current reference $I_O$ can be used to control other portions of the circuitry such as dividers and level shifters. In essence, with the same battery or supply current at room temperature, the operation temperature range of a crystal oscillator can be extended by using the integrated circuit 10 and methods of the present invention.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification and as defined in the appended claims.

That which is claimed:

1. An integrated circuit comprising:

current generating means responsive to a supply voltage for generating a first reference current;

temperature compensating voltage control signal generating means connected to the supply voltage for generating a temperature compensating voltage control signal during temperature variations;

bias controlling means responsive to said current generating means and connected to said temperature compensating voltage control signal generating means for biasingly controlling said temperature compensating voltage control signal generating means; and current output controlling means responsive to said current generating means and the temperature compensating voltage control signal for controlling a second temperature compensated reference current so as to generate a high output current even during low temperature conditions.

2. An integrated circuit as defined in claim 1, wherein said current generating means includes a cascading current mirror circuit connected to a supply voltage and a reference voltage.

3. An integrated circuit as defined in claim 2, wherein said cascading current mirror circuit comprises three pairs of field effect transistors, one of said pairs of field effect transistors having a first conductivity type and two of said pairs of field effect transistors having a second conductivity type.

4. An integrated circuit as defined in claim 3, wherein said current generating means further includes a field effect transistor connected to gates of said first pair of field effect transistors and having the same conductivity type thereof for providing the first reference current and a field effect transistor connected to the gates of a third pair of said three pairs of field effect transistors and having the same conductivity type thereof.

5. An integrated circuit as defined in claim 1, wherein said temperature compensating voltage control signal generating means comprises a temperature compensating voltage controlling circuit connected to the supply voltage and being arranged so that in a first operating state the voltage control signal decreases as temperature increases above a predetermined threshold and in a second operating state said voltage controlling circuit is disabled as temperature decreases below the predetermined threshold so that the second reference current mirrors the first reference current as the high output current during low temperature conditions.

6. An integrated circuit as defined in claim 5, wherein said temperature compensating voltage controlling circuit includes a plurality of bipolar transistors, each of said plurality of bipolar transistors being formed in a common well, having a collector connected to the supply voltage, and having an emitter connected to said bias controlling means.

7. An integrated circuit as defined in claim 6, wherein said plurality of bipolar transistors each are vertical bipolar transistors so that the integrated circuit comprises a straight CMOS arrangement.

8. An integrated circuit as defined in claim 5, wherein said temperature compensating voltage controlling circuit includes five bipolar transistors, each of said plurality of bipolar transistors having a collector connected to the supply voltage and an emitter connected to said bias controlling means, a first of said five bipolar transistors also having a base connected to the supply voltage and each of the bases of the other four bipolar transistors being connected to the emitter of the preceding one of said bipolar transistors.

9. An integrated circuit as defined in claim 3, wherein said bias controlling means comprises a plurality of field effect transistors, each of said plurality of field effect transistors having a drain connected to said temperature compensating voltage controlling means and a gate connected to at least one of the gates of at least one of said pairs of field effect transistors of said cascading current mirror circuit.

10. An integrated circuit as defined in claim 4, wherein said current output controlling means comprises a current output control circuit, said current output control circuit including a first output field effect transistor having the gate thereof connected to said temperature compensating voltage controlling means, a second output field effect transistor having the gate thereof connected to the gate of one of the first pair of said three pairs of transistors of said cascading current mirror circuit so as to form a current mirror therewith and having the source thereof connected to the drain of said first output field effect transistor, and a third output field effect transistor having the gate thereof connected to the gate of one of the third pair of said three pairs of transistors of said cascading current mirror circuit so as to form a current mirror therewith and having the drain thereof connected to the source of the first output field effect transistor.

11. An integrated circuit as defined in claim 10, wherein said current output control circuit further includes fourth and fifth output field effect transistors having the same conductivity type and having the gates thereof respectively connected to each other, the drain of the fourth output field effect transistor being connected to the respective drain and source of the first and second output field effect transistors for providing the second temperature compensated reference current.

12. An integrated circuit comprising:

a current generating circuit responsive to a supply voltage which generates a first reference current;

a temperature compensating voltage controlling circuit which generates a temperature compensating voltage control signal during temperature variations;

a bias controlling circuit connected to said current generating circuit and said temperature compensating voltage controlling circuit which biasingly controls said temperature compensating voltage controlling circuit; and a current output controlling circuit connected to said current generating circuit and said temperature compensating voltage controlling circuit which controls a second temperature compensated reference current responsive to the temperature compensating voltage control signal so as to generate a high output current even during low temperature conditions.

13. An integrated circuit as defined in claim 12, wherein said current generating circuit includes a cascading current mirror circuit connected to a supply voltage and a reference voltage.

14. An integrated circuit as defined in claim 13, wherein said cascading current mirror circuit comprises three pairs of field effect transistors, one of said pairs of field effect transistors having a first conductivity type and two of said pairs of field effect transistors having a second conductivity type.

15. An integrated circuit as defined in claim 14, wherein said current generating circuit further includes a field effect transistor connected to the gates of said first pair of field effect transistors and having the same conductivity type thereof for providing the first reference current and a field effect transistor connected to the gates of a third pair of said three pairs of field effect transistors and having the same conductivity type thereof.

16. An integrated circuit as defined in claim 15, wherein said temperature compensating voltage controlling circuit is connected to the supply voltage and is arranged so that the voltage control signal from the supply voltage to the current output controlling circuit decreases as temperature increases above a predetermined threshold and said voltage controlling circuit inhibits the voltage control signal as temperature decreases below the predetermined threshold.

17. An integrated circuit as defined in claim 16, wherein said temperature compensating voltage controlling circuit includes a plurality of bipolar transistors, each of said plurality of bipolar transistors being formed in a common well, having a collector connected to the supply voltage, and having an emitter connected to said bias controlling means.

18. An integrated circuit as defined in claim 17, wherein said plurality of bipolar transistors each are vertical bipolar transistors so that the integrated circuit comprises a straight CMOS arrangement.

19. An integrated circuit as defined in claim 18, wherein said temperature compensating voltage controlling circuit includes five bipolar transistors, each of said plurality of bipolar transistors having a collector connected to the supply voltage and an emitter connected to said bias controlling means, a first of said five bipolar transistors also having a base connected to the supply voltage and each of the bases of the other four bipolar transistors being connected to the emitter of the preceding one of said bipolar transistors.

20. An integrated circuit as defined in claim 19, wherein said bias controlling means comprises a plurality of field effect transistors, each of said plurality of field effect transistors having a drain connected to said temperature compensating voltage controlling means and a gate connected to at least one of the gates of at least one of said pairs of field effect transistors of said cascading current mirror circuit.

21. An integrated circuit as defined in claim 20, wherein said current output controlling means comprises a current output control circuit, said current output control circuit including a first output field effect transistor having the gate thereof connected to said temperature compensating voltage controlling means, a second output field effect transistor having the gate thereof connected to the gate of one of the first pair of said three pairs of transistors of said cascading current mirror circuit so as to form a current mirror therewith and having the source thereof connected to the drain of said first output field effect transistor, and a third output field effect transistor having the gate thereof connected to the gate of one of the third pair of said three pairs of transistors of said cascading current mirror circuit so as to form a current mirror therewith and having the drain thereof connected to the source of the first output field effect transistor.

22. An integrated circuit as defined in claim 21, wherein said current output control circuit further includes fourth and fifth output field effect transistors having the same conductivity type and having the gates thereof respectively connected to each other, the drain of the fourth output field effect transistor being connected to the respective drain and source of the first and second output field effect transistors for providing the second temperature compensated reference current.

23. An integrated circuit comprising:

current generating means responsive to a supply voltage for generating an output source current; and temperature compensating voltage control signal generating means responsive to the supply voltage for generating a temperature compensating voltage control signal during temperature variations, said temperature compensating voltage control signal generating means comprising at temperature compensating voltage controlling circuit connected to the supply voltage and being arranged so that the voltage control signal from the supply voltage decreases as temperature increases above a predetermined threshold and said voltage controlling circuit inhibits the voltage control signal as temperature decreases below the predetermined threshold so as to generate a high output source current even during low temperature conditions.

24. An integrated circuit as defined in claim 23, wherein the output source current generated by said current generating means comprises a first reference current, and the integrated circuit further comprising current output controlling means responsive to said current generating means and said temperature compensating voltage control signal generating means for controlling a second temperature compensated reference current so as to generate the high output source current even during low temperature conditions.

25. An integrated circuit as defined in claim 24, wherein said current generating means includes a cascading current mirror circuit connected to a supply voltage and a reference voltage.

26. An integrated circuit as defined in claim 25, wherein said cascading current mirror circuit comprises three pairs of field effect transistors, one of said pairs of field effect transistors having a first conductivity type and two of said pairs of field effect transistors having a second conductivity type.

27. An integrated circuit as defined in claim 26, wherein said current generating means further includes a field effect transistor connected to the gates of said first pair of field effect transistors and having the same conductivity type thereof for providing the first reference current and a field effect transistor connected to the gates of a third pair of said three pairs of field effect transistors and having the same conductivity type thereof.

28. An integrated circuit as defined in claim 27, wherein said temperature compensating voltage control signal generating means comprises a temperature compensating voltage controlling circuit which includes a plurality of bipolar transistors, each of said plurality of bipolar transistors being formed in a common well, having a collector connected to the supply voltage, and having an emitter connected to said bias controlling means.

29. An integrated circuit as defined in claim 28, wherein said plurality of bipolar transistors each are vertical bipolar transistors so that the integrated circuit comprises a straight CMOS arrangement.

30. An integrated circuit as defined in claim 29, wherein said temperature compensating voltage controlling circuit includes five bipolar transistors, each of said plurality of bipolar transistors having a collector connected to the supply voltage and an emitter connected to said bias controlling means, a first of said five bipolar transistors also having a base connected to the supply voltage and each of the bases of the other four bipolar transistors being connected to the emitter of the preceding one of said bipolar transistors.

31. An integrated circuit as defined in claim 30, further comprising bias controlling means responsive to said current generating means and connected to said temperature compensating voltage controlling circuit for controlling a bias of said temperature compensating voltage controlling circuit, said bias controlling means comprising five field effect transistors, each of said five field effect transistors having a drain connected to a respective emitter of said five bipolar transistors of said temperature compensating voltage controlling circuit and a gate connected to at least one of the gates of at least one of said pairs of field effect transistors of said cascading current mirror circuit.

32. An integrated circuit as defined in claim 31, wherein said current output controlling means comprises a current output control circuit, said current output control circuit including a first output field effect transistor having the gate thereof connected to said temperature compensating voltage controlling circuit, a second output field effect transistor having the gate thereof connected to the gate of one of the first pair of said three pairs of transistors of said cascading current mirror circuit so as to form a current mirror therewith and having the source thereof connected to the drain of said first output field effect transistor, and a third output field effect transistor having the gate thereof connected to the gate of one of the third pair of said three pairs of transistors of said cascading current mirror circuit so as to form a current mirror therewith and having the drain thereof connected to the source of the first output field effect transistor.

33. An integrated circuit as defined in claim 32, wherein said current output control circuit further includes fourth and fifth output field effect transistors having the same conductivity type and having the gates thereof respectively connected to each other, the drain of the fourth output field effect transistor being connected to the respective drain and source of the first and second output field effect transistors for providing the second temperature compensated reference current.

34. A method of supplying current for low power applications, the method comprising:

generating a first reference current responsive to a supply voltage;

generating a temperature compensating voltage control signal during temperature variations;

biasingly controlling the temperature compensating voltage control signal; and controlling a second temperature compensated reference current responsive to biasingly control of the temperature compensating voltage control signal so as to generate a high output source current even during low temperature conditions.

35. A method as defined in claim 34, wherein the generating a temperature compensating voltage control signal step comprises the steps of decreasing the voltage control signal when temperature increases above a predetermined threshold and inhibiting the voltage control signal when temperature decreases below the predetermined threshold.

36. A method as defined in claim 35, wherein the first reference current generating step includes mirroring current through a cascading current mirror circuit connected to a supply voltage.

37. A method as defined in claim 36, further comprising biasingly controlling a temperature compensating voltage controlling circuit during temperature variations so as to maintain the high output source current during low temperature conditions.

38. A method as defined in claim 34, further comprising providing the first reference current from a first output current source so as to control a first portion of another circuit and providing the second temperature compensated reference current from a second output current source so as to control a second portion of another circuit.

39. A method of supplying current for low power applications, the method comprising:

generating a reference current responsive to a supply voltage;

generating biasingly controlling a temperature compensating voltage control signal during temperature variations by decreasing a voltage control signal when temperature increases above a predetermined threshold and inhibiting the voltage control signal when temperature decreases below the predetermined threshold; and generating a high output source current responsive to the biasingly control of the temperature compensating voltage control signal even during low temperature conditions.

40. A method as defined in claim 39, wherein the reference current generating step includes mirroring current through a cascading current mirror circuit connected to a supply voltage, and wherein the high output source current is mirrored from the reference current during low temperature conditions.

* * * * *